US006435121B2

(12) United States Patent
Siring

(10) Patent No.: US 6,435,121 B2
(45) Date of Patent: Aug. 20, 2002

(54) SLIDING SHOE FAIRLEAD WITH AN INTEGRATED CHAIN STOPPER

(75) Inventor: Knut T. Siring, Arendal (NO)

(73) Assignee: Maritime Pusnes AS, Arendal (NO)

( * ) Notice: Subject to any disclaimer, the term of this patent is extended or adjusted under 35 U.S.C. 154(b) by 0 days.

(21) Appl. No.: 09/841,866

(22) Filed: Apr. 25, 2001

(30) Foreign Application Priority Data

Apr. 28, 2000 (NO) ..... 20002285

(51) Int. Cl.[7] ..... B63B 21/18
(52) U.S. Cl. ..... 114/200
(58) Field of Search ..... 114/200, 293, 114/199; 254/389, 391, 415

(56) References Cited

U.S. PATENT DOCUMENTS 5,845,893 A * 12/1998 Groves ..... 114/293
2001/0029878 A1 * 10/2001 Seaman et al.

* cited by examiner

*Primary Examiner*—Ed Swinehart

(74) *Attorney, Agent, or Firm*—Timothy J. Keefer; Wildman, Harrold, Allen & Dixon

(57) ABSTRACT

A holding and guiding device for a mooring chain, mounted pivotally about a vertical axis (5) and having an integrated chain stopper (2) mounted above the glide track (4) on top of the fairlead. The glide track (4) has a longitudinal slot (11) providing room for the standing links (9) of the chain and has flat parts (3) supporting the lying links (8) of the chain in order to avoid that these become subjected to bending moments when the chain is loaded. In the middle of the flat parts (3) the glide track has deviations (12) providing room for the welds of the chain. Between the flat parts (3) the glide track (4) is evenly rounded in the longitudinal direction. The slot (11) of the glide track has one or more shallower parts which, when the chain is pulled in, force the standing links (9) outwards so that they in turn lift the ends of the lying links (8) of the chain away from the glide track (4). The integrated chain stopper comprises pawl arms (2) or locking lugs (19) engaging under a chain link and thereby holding the chain fast. The pawl arms or locking lugs are supported on separate shafts (14), so that they may be pivoted in and out. The chain stopper may be remotely operated by means of wires (15, 16) which are attached to the pawl arms or locking lugs. These wires (15, 16) are guided in the correct direction through bent pipes (18) attached to the structure of the chain stopper.

15 Claims, 4 Drawing Sheets

SLIDING SHOE FAIRLEAD WITH AN INTEGRATED CHAIN STOPPER

SUMMARY OF THE INVENTION

The invention relates to a combined guide fairlead and chain stopper for mooring chains on floating offshore installations.

On floating installations offshore the anchor chains are guided over guide fairleads mounted in the lower part of the hull. This arrangement generally has two objects, namely to move the point of attack for the mooring forces as far down on the installation as possible, in addition to guide the chain onto the anchor winches at the most favorable angle. The most usual type of guide fairlead for chains is a type of roller fairlead without chain stopper. This fairlead has a guide sheave of cast steel mounted in a cradle which pivots to both sides about a vertical axis. As a result, the chain may move in two planes towards the guide fairlead. The arrangement of a guide sheave results in the chain being treated in a gentle manner, but the arrangement consists of relatively many parts, thus making it quite heavy and expensive.

Another type of guide fairlead, the glide shoe fairlead (also called bending shoe fairlead), has a fixed glide track instead of a rotating guide sheave. It is simpler and less expensive than roller fairleads, but have clear drawbacks regarding how the chain is treated. Since the glide track is formed with an even radius in the longitudinal direction of the chain, the lying links will be subjected to bending moments when the chain is tensioned. This is the most undesirable form of loading for a chain, particularly since the bending moment occurs in the welding zone of the chain links. Since the chain is locked on deck, there is a relatively long length of chain extending between the chain stopper and the glide fairlead. This results in a certain gliding between the chain and the glide fairlead with varying tensile loads in the chain, the result being wear, particularly on the glide track, but also on the chain. There are glide shoe fairleads having an integrated chain stopper. One embodiment has the chain stopper mounted after the glide track in an extension thereof, so that the chain is fixed after the glide shoe fairlead and the chain hanging loosely along the glide track of the fairlead. In this case, the chain stopper is supported in bearings in two planes and may pivot with the chain. This arrangement transfers the wear from the chain to the supporting bearings of the chain stopper. A drawback of this arrangement is that it contains relatively many moving parts so that the manufacturing becomes expensive. It is also relatively difficult to operate the chain stopper from the deck of the platform.

The object of the present invention is to avoid the drawbacks mentioned above. This is obtained i.a. by the chain being fixed immediately above the glide track. The arrangement according to the invention, which is defined in claim 1, entails that the chain will lie in an even radius without being subjected to bending moments in the lying links.

The integrated chain stopper mounted immediately above the glide shoe entails that the chain is held fast without scrubbing in the longitudinal direction of the glide track, a fact that reduces wear on the chain and glide track to a minimum. Since the links of the chain will lie in the same position each time the chain is locked, the glide track may be formed with flat parts which support the lying links in their entire length. Between these flat parts the glide track is rounded in order for the chain to glide without problems when it is heaved in. In order to avoid that the links are subjected to high bending moments when the chain is heaved in, i.e. when they pass over the rounded parts, the bottom of the slot in the glide track is shaped in such a way that the standing chain links are pressed outwards and lift the lying chains somewhat up from the glide track. As a result, the chain will move in an approximately even radius when it is pulled in.

The glide shoe fairlead is made with side walls that continue for a relatively long distance after the bend in the glide track. This has the result that the fairlead will pivot along when the chain pivots laterally, even when the movements are small. If the glide fairlead had been provided with side walls of the glide track that were too short, it would have been standing still without pivoting along during smaller lateral movements of the chain. In such a case, the first chain links in the fairlead would have to absorb these movements, the result being that a few links would receive much wear. By transmitting this movement to the bearings in the vertical axis of the glide fairlead, the wear on the chain is reduced to a minimum.

A chain remaining in the same position in the longitudinal direction over a longer period of time may receive some wear on the links located in the glide fairlead. This results from vertical movements of the chain. In order to distribute this wear over several links of the chain, it is important to be able to pull in and let out the chain at regular intervals. The chain stopper is made in such a way that it can be remotely controlled from the deck. As a result, it does not take much work to pull in or let out the chain a few links at regular intervals.

The glide shoe fairlead according to the invention is shown in the appended drawings by way of a non-limiting exemplifying embodiment where:

DESCRIPTION OF THE PREFERRED EMBODIMENT

The glide shoe fairlead 1 is supported by bearings on a vertical shaft 5, which in turn is attached between an upper bracket 6 and a lower bracket 7. This arrangement permits the fairlead to pivot to both sides.

Figure 6:
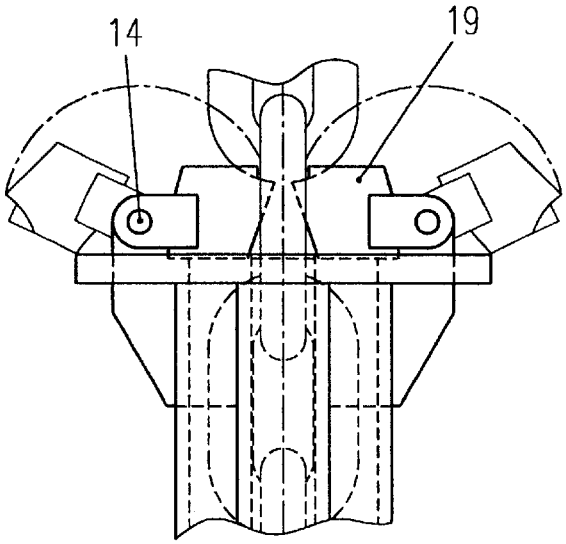
FIGS. 6 and 7 show an alternative embodiment of the chain stopper, FIG. 6 being seen from the front and FIG. 7 being seen from the side.
Figure 7:
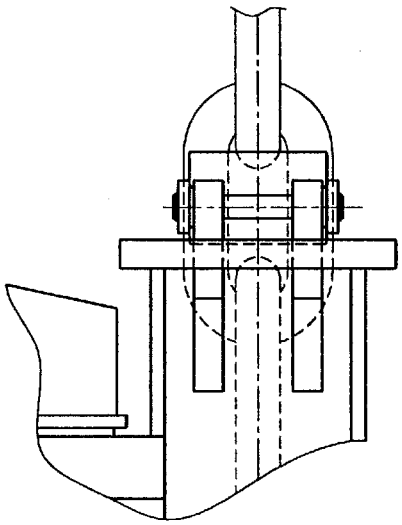

A chain stopper 2 is mounted above the glide track 4 and is made of two pawl arms, one on either side of the chain, which engage under a chain link and hold it in position. These pawl arms are pivotally supported on individual shafts 14, which may be load cells for measuring chain tension. Alternatively, the pawl arms may be made in the form of locking lugs 19, FIG. 6, which may be placed under a chain link to lock it.

Figure 4:
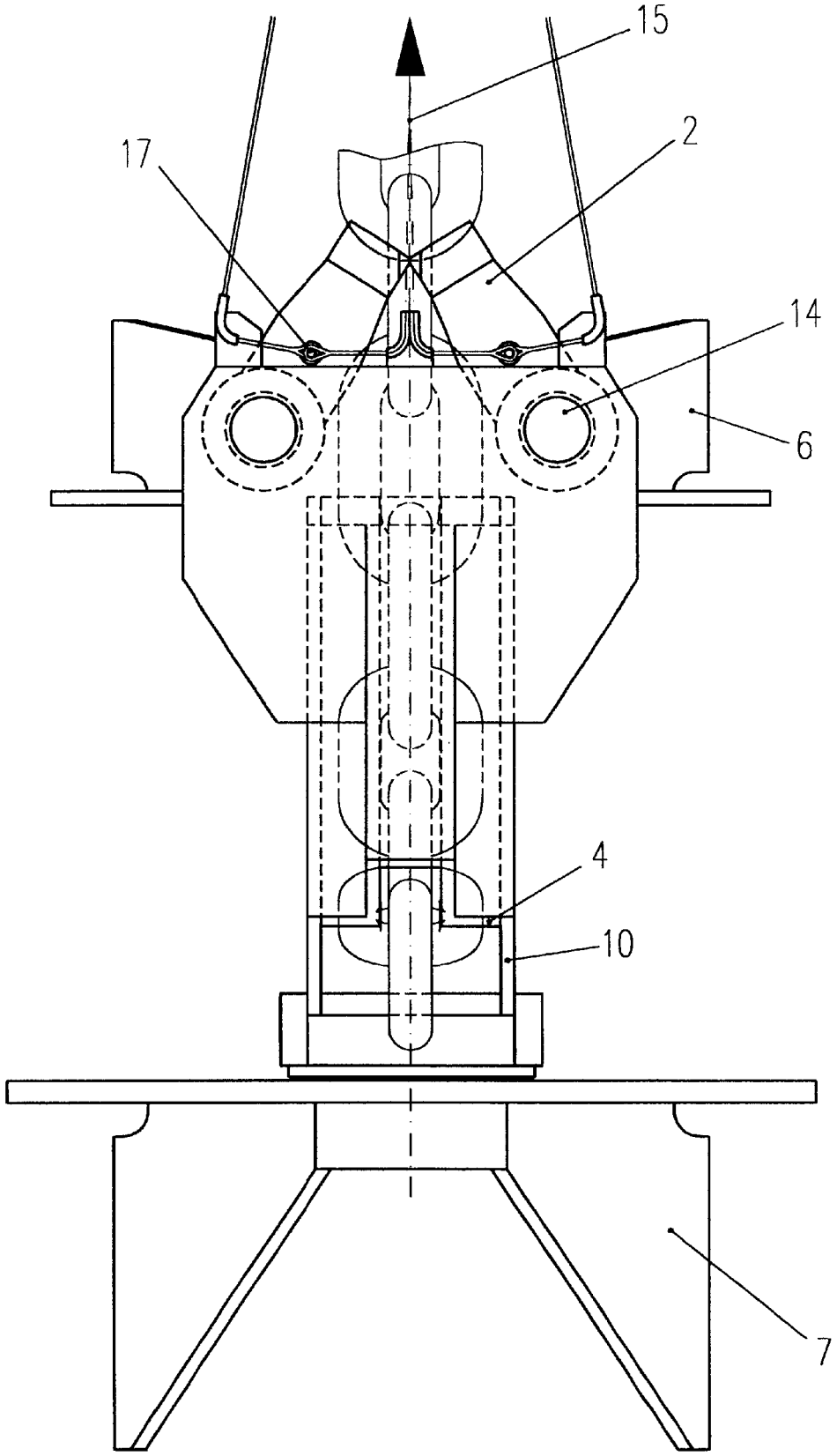
FIG. 4 shows the fairlead seen from the front (towards the column) with the chain stopper closed. Here also the device for opening and closing the chain stopper is shown.
Figure 5:
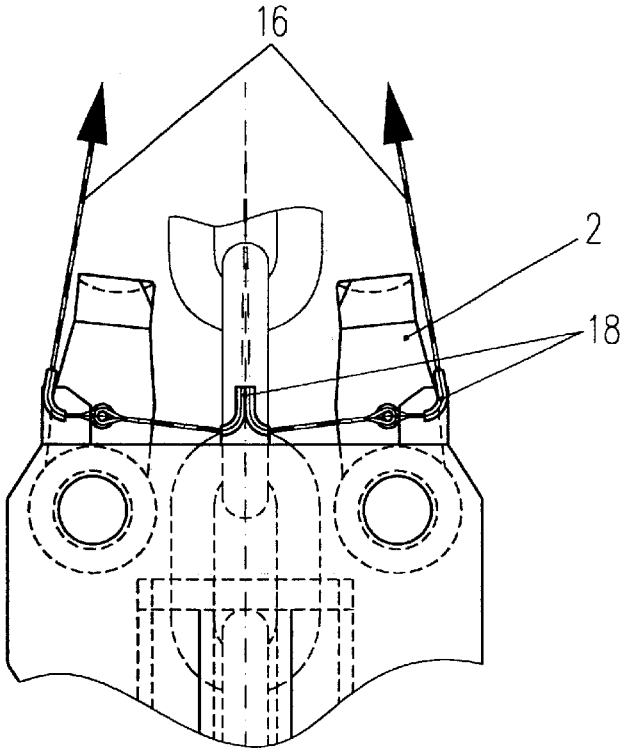
FIG. 5 shows parts of the chain stopper seen from the front with the stopper in the open position.

The device for remote control of the chain stopper may be made as shown in FIGS. 4 and 5. Wires 15 and 16 are attached to a pin 17 on each of the locking pawls 2 and extend through individual bent pipes 18 leading the wires upwards in the correct direction. If the wire 15 is pulled, the pawls will pivot inwards and lock the chain, and if the wire 16 is pulled, the pawls will pivot outwards and release the chain.

The glide track 4 is provided with a longitudinal slot 11 which gives room for the standing links 9 of the chain. The surface 4 of the glide track is provided with flat parts 3 which support the lying links 8 of the chain over most of their length. The flat parts 3 have a deviated area 12 which provides room for the weld of the lying chain link and prevents bending moments from being induced.

Figure 1:
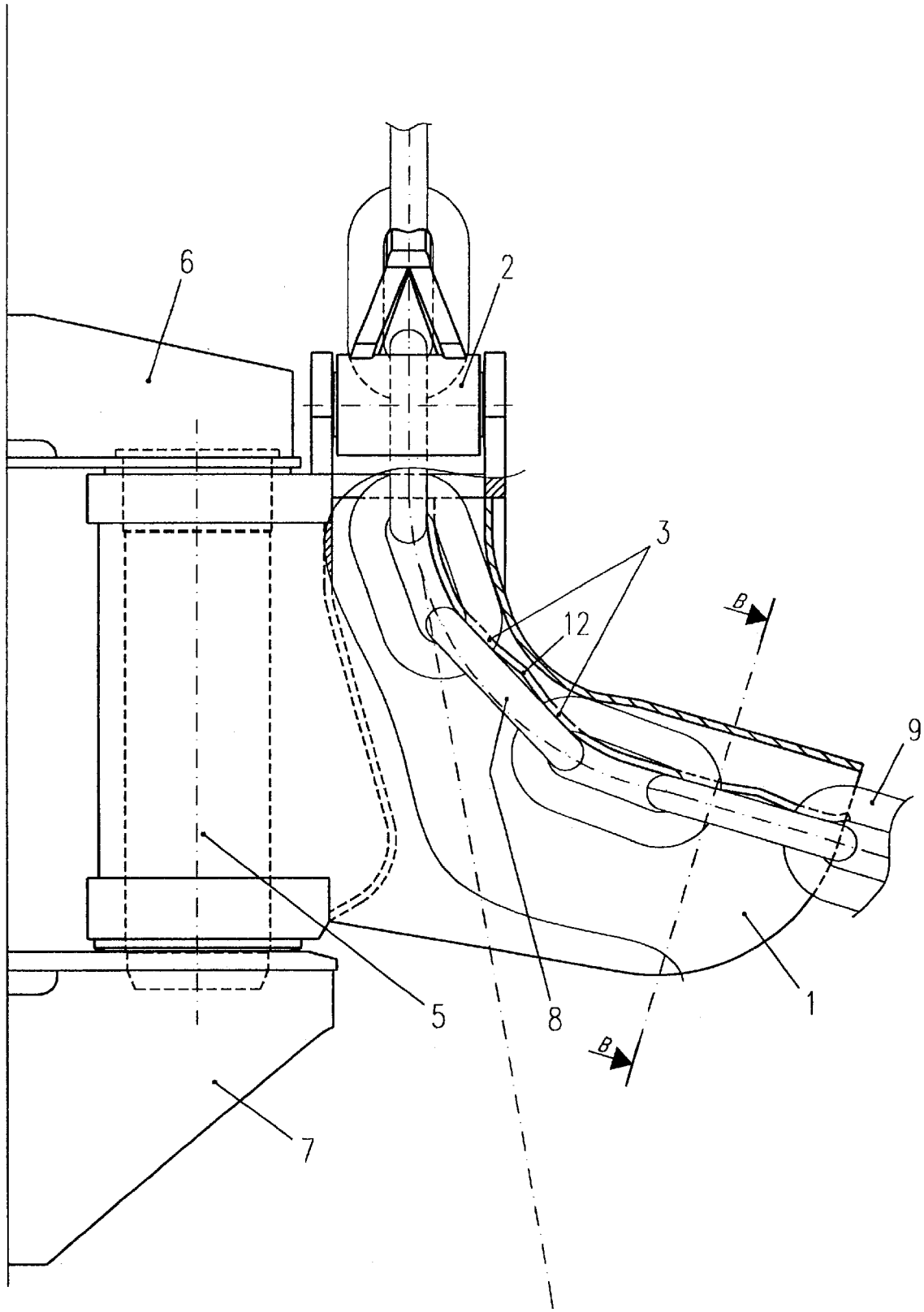
FIG. 1 shows a side view of the fairlead where one side wall is partially removed.
Figure 2:
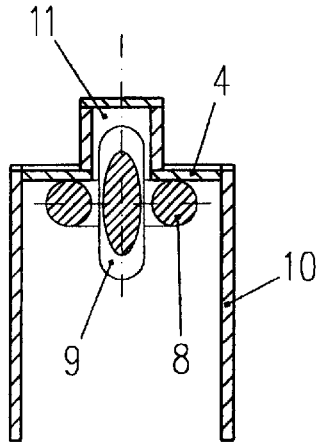
FIG. 2 shows a section B—B through the glide track seen in the longitudinal direction of the chain.
Figure 3:
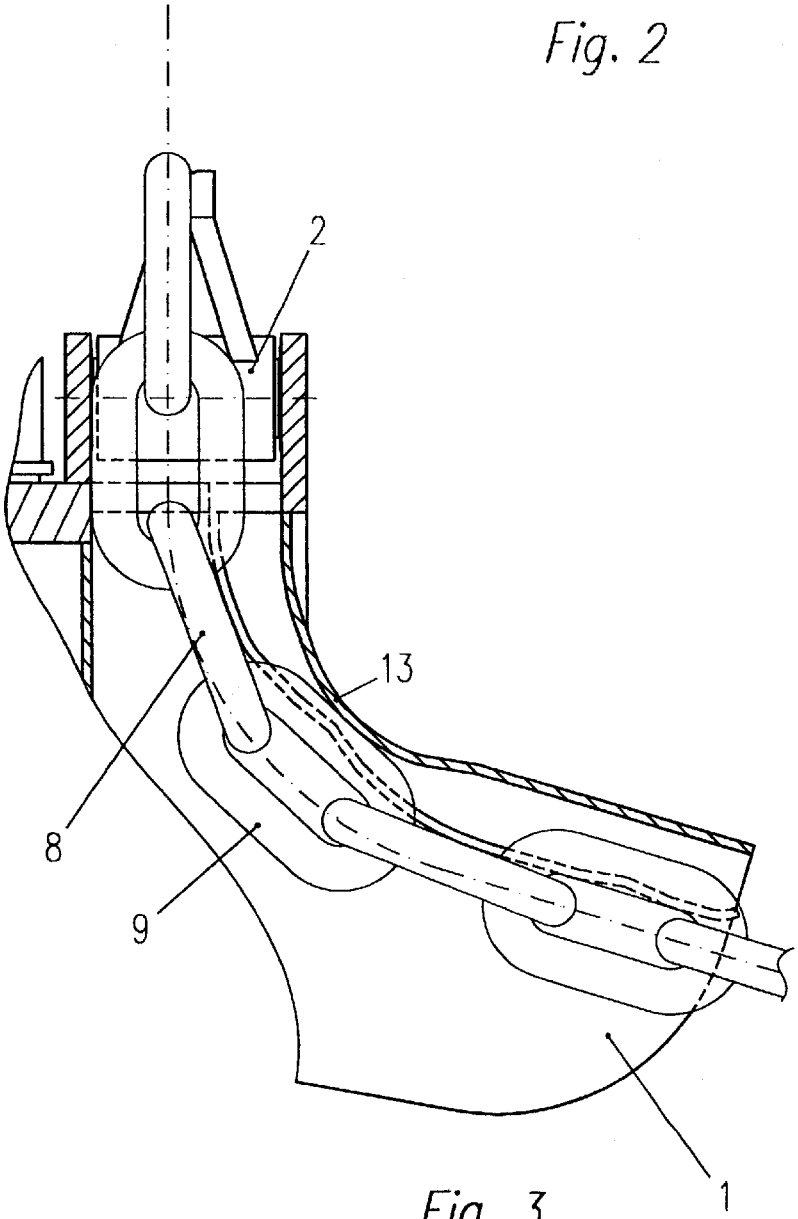
FIG. 3 shows the fairlead with the chain stopper in the open position, with the chain in an intermediate position where a standing link presses the lying links away from the glide track.

Between the flat parts 3 of the glide track 4 the track is rounded with an even radius in order to facilitate gliding of the chain on the glide track 4. When the chain is pulled in over the glide shoe, the lying links 8 must pass over the rounded parts of the glide track, a situation that will induce a certain bending load in the chain. An area of the slot 11 of the glide track has a part 13, FIG. 3, which presses the standing links 9 of the chain somewhat outwards. As a result, they lift the ends of the lying links 8 of the chain somewhat up from the glide track 4 and distribute the bending between the standing links 9 and lying links 8 of the chain.

The side plates 10 of the glide shoe extend quite far out in the lower area where the chain leaves the glide shoe. This provides lateral support for the chain for as long as possible before it leaves the glide shoe, thus making it easier for the fairlead to swing along when the chain is moved laterally.

What is claimed is:

1. A glide shoe fairlead with an integrated chain stopper for holding and guiding a mooring chain, comprising a chain stopper and a glide track having a longitudinal slot and being pivotal about a vertical axis, wherein the chain stopper is mounted immediately above the glide track, the glide track being provided with one or more flat parts for supporting lying links of the chain, the flat parts each having a deviated area providing room for a weld in a link of the chain.

2. A fairlead according to claim 1, wherein the glide track is evenly rounded in the longitudinal direction between at least some of the one or more flat parts.

3. A fairlead according to claim 1, wherein the slot in the glide track is provided with one or more shallower parts between the one or more flat parts of the glide track in such a manner that when a standing chain link passes thereby, it lifts the engaged ends of the lying links clear of the glide track.

4. A fairlead according to claim 1, wherein the chain stopper is provided with one or two pawl arms or locking lugs, able to engage under a chain link and thereby hold the chain fast.

5. A fairlead according to claim 4, wherein the locking pawls or locking lugs are supported on separate shafts so as to be pivotal out and in.

6. A fairlead according to claim 4, wherein the chain stopper may be remotely operated by means of wires which are attached to the pawl arms or locking lugs.

7. A fairlead according to claim 5, wherein the chain stopper may be remotely operated by means of wires which are attached to the pawl arms or locking lugs.

8. A glide shoe fairlead with an integrated chain stopper for holding and guiding a mooring chain, comprising a chain stopper and a glide track having a longitudinal slot and being pivotal about a vertical axis, wherein the chain stopper is mounted immediately above the glide track, the glide track being provided with one or more flat parts for supporting lying links of the chain, the glide track being evenly rounded in the longitudinal direction between at least some of the one or more flat parts.

9. A fairlead according to claim 8, wherein the slot in the glide track is provided with one or more shallower parts between the one or more flat parts of the glide track in such a manner that when a standing chain link passes thereby, it lifts the engaged ends of the lying links clear of the glide track.

10. A fairlead according to claim 8, wherein the chain stopper is provided with one or two pawl arms or locking lugs, able to engage under a chain link and thereby hold the chain fast.

11. A fairlead according to claim 10, wherein the locking pawls or locking lugs are supported on separate shafts so as to be pivotal out and in.

12. A glide shoe fairlead with an integrated chain stopper for holding and guiding a mooring chain, comprising a chain stopper and a glide track having a longitudinal slot and being pivotal about a vertical axis, wherein the chain stopper is mounted immediately above the glide track, the glide track being provided with one or more flat parts for supporting lying links of the chain, the slot in the glide track being provided with one or more shallower parts between the one or more flat parts of the glide track in such a manner that when a standing chain link passes thereby, it lifts the engaged ends of the lying links clear of the glide track.

13. A fairlead according to claim 12, wherein the chain stopper is provided with one or two pawl arms or locking lugs, able to engage under a chain link and thereby hold the chain fast.

14. A fairlead according to claim 13, wherein the locking pawls or locking lugs are supported on separate shafts so as to be pivotal out and in.

15. A fairlead according to claim 13, wherein the chain stopper may be remotely operated by means of wires which are attached to the pawl arms or locking lugs.

* * * * *